US008613849B2

(12) United States Patent
Wong et al.

(10) Patent No.: US 8,613,849 B2
(45) Date of Patent: Dec. 24, 2013

(54) ELECTROPOLISHING SOLUTION CONTAINING PHOSPHOROUS PENTOXIDE AND METHODS OF USE THEREOF

(75) Inventors: Sophia L. Wong, Milpitas, CA (US); William E. Webler, Jr., San Jose, CA (US); Dariush Davalian, San Jose, CA (US)

(73) Assignee: Abbott Cardiovascular Systems, Inc., Santa Clara, CA (US)

( * ) Notice: Subject to any disclaimer, the term of this patent is extended or adjusted under 35 U.S.C. 154(b) by 147 days.

(21) Appl. No.: 13/271,504

(22) Filed: Oct. 12, 2011

(65) Prior Publication Data

US 2013/0092554 A1 Apr. 18, 2013

(51) Int. Cl.

| | |
|---|---|
| ***C25F 7/02*** | (2006.01) |
| ***C25F 3/16*** | (2006.01) |
| ***C25B 15/08*** | (2006.01) |

(52) U.S. Cl.

USPC ..... 205/673; 205/682; 205/675; 204/232

(58) Field of Classification Search

USPC ..... 205/640–686; 204/232–241

See application file for complete search history.

(56) References Cited

U.S. PATENT DOCUMENTS

| | | | | |
|---|---|---|---|---|
| 3,203,884 | A * | 8/1965 | Hans Laub et al. | 205/680 |
| 6,375,826 | B1 * | 4/2002 | Wang et al. | 205/684 |
| 7,771,581 | B2 * | 8/2010 | Callol et al. | 205/640 |
| 2013/0092556 | A1 | 4/2013 | Wong et al. | |
| 2013/0092557 | A1 | 4/2013 | Wong et al. | |

* cited by examiner

*Primary Examiner* — Nicholas A Smith

*Assistant Examiner* — Brian W Cohen

(74) *Attorney, Agent, or Firm* — Workman Nydegger; John Kwok

(57) ABSTRACT

Substantially anhydrous electropolishing electrolyte solutions. The substantially anhydrous electropolishing electrolyte solutions described herein do not use water as a solvent; instead, such electropolishing electrolyte solutions use anhydrous alcohols and/or glycols as a solvent. For example, an electropolishing electrolyte solution, as described herein, may include an alcohol, at least one mineral acid, and phosphorous pentoxide ("$P_2O_5$"). Methods of electropolishing metal articles using such electropolishing electrolyte solutions are disclosed herein as well.

15 Claims, 3 Drawing Sheets

ELECTROPOLISHING SOLUTION CONTAINING PHOSPHOROUS PENTOXIDE AND METHODS OF USE THEREOF

BACKGROUND

The present disclosure relates generally to electrolyte solutions that can be used for electropolishing articles made from metals, and in particular, for electropolishing metallic medical devices (e.g., stents, closure devices, and the like) made of stainless steel, titanium, tungsten, nickel-titanium, tantalum, cobalt-chromium-tungsten, tantalum-nickel-tungsten, etc. While the electrolyte solutions described herein are mainly applicable to metallic medical devices, the disclosure is not limited to such medical devices. For example, the methods may be applied to electropolish metallic automotive or aerospace components.

Electropolishing is an electrochemical process by which some of the surface metal is electrolytically dissolved. In general, the metal article (e.g., a stent) is connected to an anode and connected to a power supply while immersed in an electrolyte solution. A metal cathode connected to the negative terminal of the power supply is also included in the electrolyte solution. Metal is removed from the anode surface by the action of the current and the electrolyte solution as current flows from the metal article (as the anode) to the cathode. The rate at which metal is dissolved from the metal article is controlled, at least in part, by the applied current and/or voltage, the positioning of the cathode relative to the metal articles, and/or distribution of the electrolyte around the article. According to the theory of electropolishing, the current density is highest at high points protruding from a surface and is lowest at the surface low points. Thus, the higher current density at the raised points causes the metal to dissolve faster at these points which thus levels the surface.

Stents are generally tube-shaped intravascular devices placed within a blood vessel to maintain the patency of the vessel and, in some cases, to reduce the development of restenosis. Stents may be formed in a variety of configurations which are typically expandable since they are delivered in a compressed form to the desired site. Example stent designs include, but are not limited to, helically wound wire, wire mesh, weaved wire, serpentine stent, a chain of rings, or laser cut tubular stents. The walls of stents are typically perforated in a framework design of wire-like connected elements or struts or in a weave design of cross-threaded wire. Some stents are made of more than one material. The stent may be, for example, a sandwich of metals having outer layers of a biocompatible material, such as stainless steel, with an inner layer providing the radioopacity to the stent needed for tracking by imaging devices during placement. In forming such stents from metal, a roughened outer surface of the stent may result from the manufacturing process (e.g., from processes such as tube drawing and laser cutting).

It is desirable for the surface of the stent to be smooth so that it can be easily inserted and traversed with low friction through the blood vessels toward the site of implantation. In addition, a rough outer surface may also damage the lining of the vessel wall during insertion. Furthermore, smooth surfaces decrease the probability of thrombogenesis and corrosion. Likewise, stents having a smooth, mirror-like finish generally have a better fatigue life because surface defects (scratches, burrs, inclusions, and the like) can be sites for crack propagation.

Since the processing to form metallic stents often results in a product initially having undesirable burrs, sharp ends or debris and slag material from melting the metal during processing, mechanical cleaning (e.g., interior and exterior grinding), chemical cleaning (e.g., descaling), or the like are generally performed. Following cleaning, further surface treatment such as electropolishing is generally performed. Electropolishing is able to provide a mirror-like, defect-free surface to the metal article (e.g., the stent).

BRIEF SUMMARY

The present disclosure relates to a substantially anhydrous electropolishing electrolyte solution. The substantially anhydrous electropolishing electrolyte solutions described herein do not use water as a solvent; instead, such electropolishing electrolyte solutions use anhydrous alcohols and/or glycols as a solvent. For example, an electropolishing electrolyte solution, as described herein, may include an alcohol, at least one mineral acid, and phosphorous pentoxide ("$P_2O_5$"). Methods of electropolishing metal articles using such electropolishing electrolyte solutions are disclosed herein as well. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

In one embodiment, an electropolishing electrolyte solution is described. The electropolishing electrolyte solution includes an alcohol, at least one mineral acid, and $P_2O_5$. Preferably, the electropolishing electrolyte solution is substantially anhydrous due to the fact that water can poison the electropolishing solution and reduce the ability of the solution to electropolish metal articles. Likewise, water in the electropolishing electrolyte can be broken down under electropolishing conditions, which can lead to the formation of gas bubbles that can adhere to the surface of the articles being electropolished and harm surface quality. If water is introduced into the electropolishing electrolyte solution, the $P_2O_5$ is capable of degrading the water in the solution by reacting with the water to produce phosphoric acid.

In one embodiment, the alcohol is substantially anhydrous (i.e., about 100% or absolute) methanol. One will appreciate, however, that other alcohols and glycols may be substituted for or used in combination with the methanol. Suitable examples of alcohols and glycols include, but are not limited to, ethanol, isopropanol, ethylene glycol, and propylene glycol.

In one embodiment, the mineral acid solution of the electropolishing electrolyte solution includes about 5 volume % ("vol %") to about 7 vol % sulfuric acid and about 3 vol % to about 14 vol % methanolic hydrochloric acid.

In a specific embodiment, the electropolishing electrolyte solution includes: about 79.5 vol % methanol, about 14 vol % concentrated methanolic hydrochloric acid, about 6.5 vol % concentrated sulfuric acid, and $P_2O_5$. Preferably, the $P_2O_5$ is encapsulated. That is, the $P_2O_5$ may be pelletized and coated with a coating agent, such as carrageenan, agar agar, a polyethylene glycol, a cellulose gum, starch, and the like.

In one embodiment, the electropolishing electrolyte solution may further include at least one agent that is capable of sequestering water evolved during the electropolishing process. For example, the agent capable of sequestering water may be a polyethylene glycol, such as PEG 1000.

In another embodiment, a method for scavenging water in an electropolishing electrolyte solution is described. The method includes (1) positioning a substantially anhydrous electropolishing electrolyte solution in an electropolishing apparatus, (2) adding a first quantity of $P_2O_5$ to the substantially anhydrous electropolishing electrolyte solution, and (3) electropolishing a metal article in the substantially anhydrous electropolishing electrolyte solution in the electropolishing cell, wherein water evolved during the electropolishing process is scavenged by the phosphorous pentoxide and converted to phosphoric acid.

The methods described herein may further include electropolishing at a substantially constant electrical current while monitoring voltage across the electropolishing cell, and adding a second quantity of $P_2O_5$ to the electropolishing electrolyte solution when the voltage exceeds a selected value. That is, as water is evolved as a by-product of the electropolishing process or as water is absorbed from the air, the $P_2O_5$ may be fully consumed. As the water concentration in the electropolishing electrolyte solution increases, the observed resistance of the solution may increase as the efficiency of the electropolishing process drops, leading to the need to increase the voltage in order to maintain a substantially constant current. As such, additional $P_2O_5$ may be added to scavenge the water in the electropolishing electrolyte solution and thereby restore the electropolishing electrolyte solution.

These and other objects and features of the present disclosure will become more fully apparent from the following description and appended claims, or may be learned by the practice of the invention as set forth hereinafter.

BRIEF DESCRIPTION OF THE DRAWINGS

To further clarify the above and other advantages and features of the present disclosure, a more particular description of the embodiments of the invention will be rendered by reference to specific embodiments thereof which are illustrated in the appended drawings. It is appreciated that these drawings depict only illustrated embodiments of the disclosure and are therefore not to be considered limiting of its scope. The embodiments of the invention will be described and explained with additional specificity and detail through the use of the accompanying drawings in which.

DETAILED DESCRIPTION

The present disclosure relates to a substantially anhydrous electropolishing electrolyte solution. The substantially anhydrous electropolishing electrolyte solutions described herein do not use water as a solvent; instead, such electropolishing electrolyte solutions use anhydrous alcohols and/or glycols as a solvent. For example, an electropolishing electrolyte solution, as described herein, may include an alcohol, at least one mineral acid, and phosphorous pentoxide ("$P_2O_5$"). Methods of electropolishing metal articles using such electropolishing electrolyte solutions are disclosed herein as well. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

Figure 1:
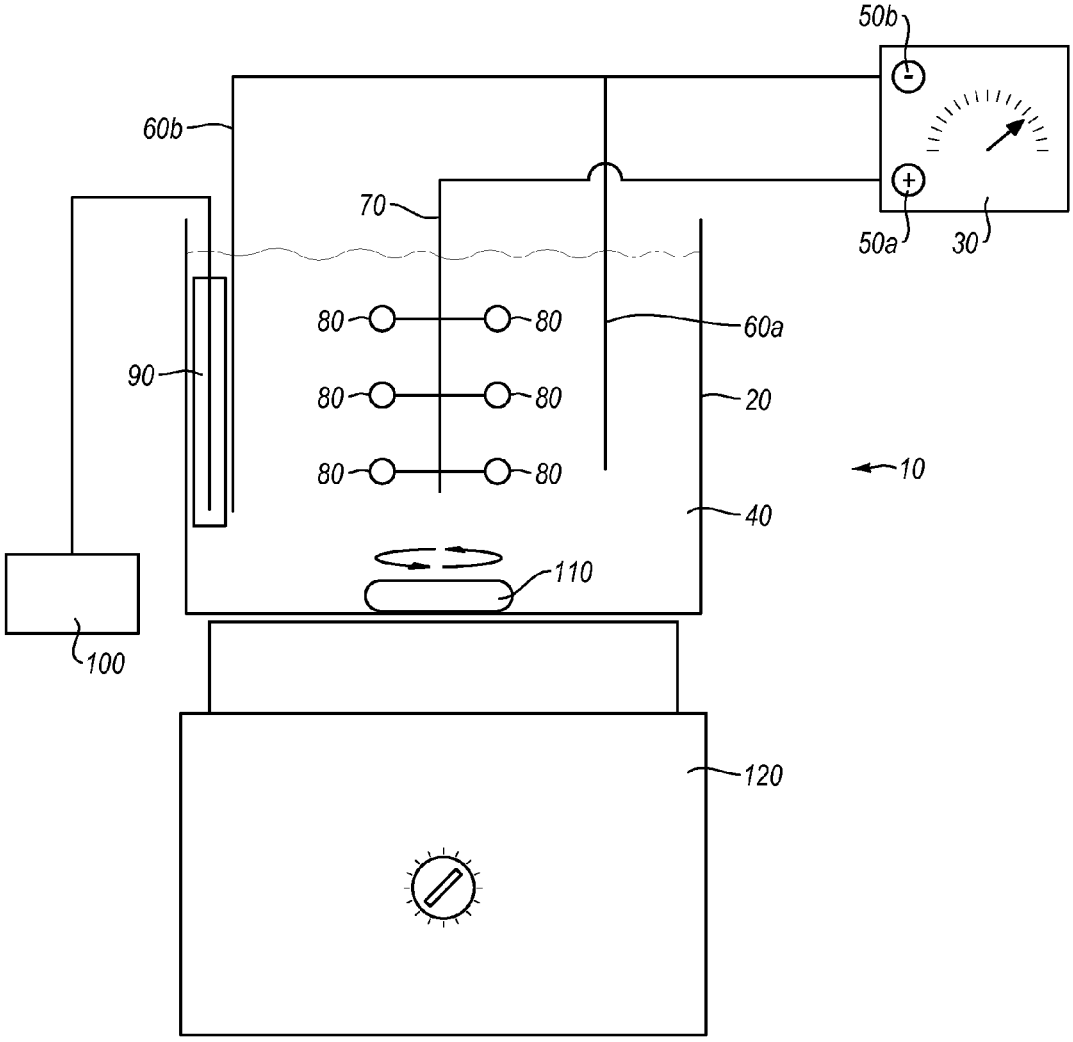
FIG. 1 is a schematic illustrating an electropolishing apparatus suitable for practicing the electropolishing embodiments described herein.

A schematic of a typical electropolishing apparatus 10 suitable for practicing the electropolishing embodiments described herein is illustrated in FIG. 1. The typical electropolishing apparatus 10 includes an electrolyte reservoir 20 that is configured to hold an electropolishing electrolyte solution 40. The typical electropolishing apparatus 10 further includes one or more cathode conductors 60*a* and 60*b*, an anode 70, and a direct current ("DC") power supply 30.

In the typical electropolishing apparatus 10, a number of metal work pieces 80 (e.g., stents) are electrically connected to the anodic (or positive) terminal 50*a* of the power supply 30 via anode 70, while the cathodic (or negative) terminal 50*b* of the power supply 30 is connected to cathodes 60*a* and 60*b*. The anode 70 and the cathode(s) 60*a* and 60*b* are connected to the DC power supply 30 and suspended in the reservoir 20 in the electrolyte solution 40. The anode 70 and the cathode 60*a* and 60*b* are submerged in the solution, forming a complete electrical circuit with the electropolishing electrolyte solution 40. A DC current is applied to the anode 70 and the cathode 60*a* and 60*b* to initiate the electropolishing process.

As further illustrated in FIG. 1, the electropolishing apparatus 10 may also include a combined temperature probe and heating/cooling unit 100 that, in the illustrated embodiment, is submerged in the electropolishing electrolyte solution 40. In the electropolishing methods described herein, for example, electropolishing is carried out with the electropolishing electrolyte solution 40 at or below about 0° C. due at least in part to safety issues associated with the electrolyte 40. The electropolishing process can create a heat, so it can be important to include a temperature control/monitoring system. Other configurations for monitoring/controlling the temperature of the electropolishing electrolyte solution 40 may be used in other embodiments.

The electropolishing apparatus 10 may also include a magnetic stir plate 120 and a magnetic stir bar 110 for mixing the electropolishing electrolyte solution 40 and ensuring even distribution of the electrolyte 40 around the workpieces 80 and the electrodes 60*a*, 60*b*, and 70. Other configurations for mixing the electropolishing electrolyte 40 may be used in other embodiments.

Figure 2A:
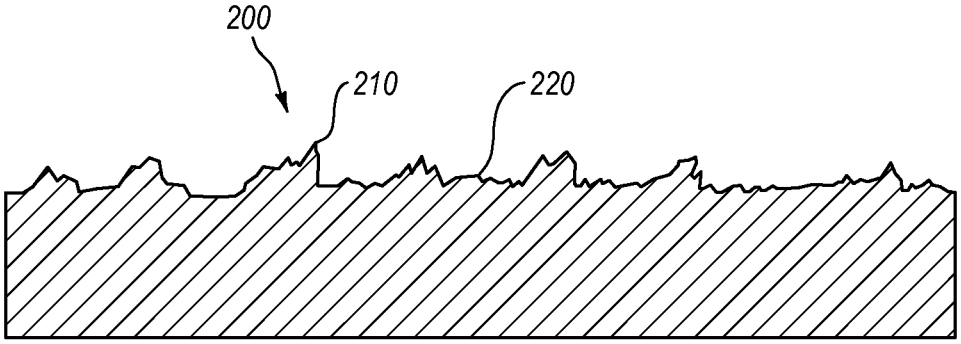
FIGS. 2A and 2B are schematic cross-sectional views illustrating the effect of electropolishing on surface finish.
Figure 2B:
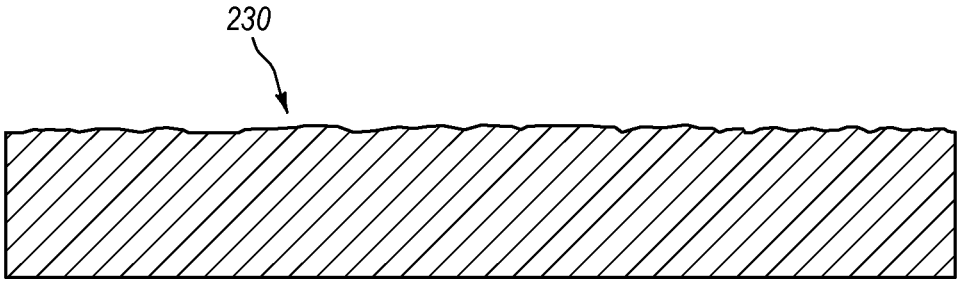

The quantity of metal removed from the work piece is proportional to the amount of current applied and the time. Other factors, such as the geometry of the work piece, affect the distribution of the current and, consequently, have an important bearing upon the amount of metal removed in local areas. For example, FIGS. 2A and 2B illustrate a surface 200 and 230 before and after electropolishing. Sharp regions, such as burrs and sharp edges, illustrated at 210 in FIG. 2A have higher current density than smoother areas illustrated at 220, which leads to the preferential removal of material from the sharp regions 210 and relatively little material removal from the smoother regions. The principle of differential rates of metal removal is important to the concept of deburring accomplished by electropolishing. Fine burrs have very high current density and are, as a result, rapidly dissolved. Smoother areas have lower current density and, as a result, less material is removed from these areas. The result of electropolishing is illustrated in FIG. 2B. As can be seen, the sharp regions illustrated at 210 in FIG. 2A are eroded away leaving a substantially flat, defect free surface 230.

In the course of electropolishing, the work piece is manipulated to control the amount of metal removal so that polishing is accomplished and, at the same time, dimensional tolerances are maintained. Electropolishing literally dissects the metal crystal atom by atom, with rapid attack on the high current density areas and lesser attack on the low current density areas. For most materials, the result is an overall reduction of the surface profile with a simultaneous smoothing and brightening of the metal surface.

Electropolishing produces a number of favorable changes in a metal work piece (e.g., a stent). These favorable changes include, but are not limited to one or more of:

Brightening
Burr removal
Oxide and tarnish removal
Reduction in surface profile
Removal of surface occlusions
Increased corrosion resistance
Improved adhesion in subsequent plating
Removal of directional lines
Radiusing of sharp edges, sharp bends, and corners
Reduced surface friction
Stress relieved surface

Electropolishing Electrolyte Solutions

In one embodiment, an electropolishing electrolyte solution is described. The electropolishing electrolyte solution includes an alcohol, at least one mineral acid, and $P_2O_5$. In one embodiment, the at least one mineral acid may include about 3 volume % ("vol %") to 12 vol % sulfuric acid and about 0 vol % to about 30 vol % methanolic HCl; or about 6 vol % to 9 vol % sulfuric acid and about 7 vol % to about 28 vol % methanolic HCl; or about 6 vol % to 9 vol % sulfuric acid and about 12 vol % to about 20 vol % methanolic HCl. In another embodiment, the at least one mineral acid includes about 5 vol % to about 7 vol % sulfuric acid and about 3 vol % to about 14 vol % methanolic hydrochloric acid. In a specific embodiment, the electropolishing electrolyte solution includes about 79.5 vol % methanol, about 14 vol % concentrated methanolic hydrochloric acid, about 6.5 vol % concentrated sulfuric acid, and phosphorus pentoxide.

Conventional hydrochloric acid is made by dissolving hydrogen chloride gas in water. Most commercially available concentrated hydrochloric acid contains about 38 vol % of hydrogen chloride dissolved in water. The hydrochloric acid used in the electropolishing electrolyte solutions described herein is different. Instead of dissolving hydrogen chloride gas in water, the concentrated hydrochloric acid used herein is essentially anhydrous due to the fact that the hydrogen chloride gas is dissolved in methanol. Such acid is generally referred to as methanolic hydrochloric acid or methanolic HCl. Methanolic HCl is available commercially in a 3N solution. Hydrogen chloride gas can also be dissolved in other alcohols such as, but not limited to, ethanol and 2-propanol. Commercially available concentrated sulfuric acid is approximately 18.4 molar and is typically 95-98% pure. In a specific embodiment, the sulfuric acid (98%) is 18.4 M prior to mixing, which is diluted to 1.19 M once mixed in the final solution and the methanolic HCl is 3N prior to mixing, which is diluted to 0.42 M once mixed in the final solution. Electropolishing electrolytes containing other acids and acid mixtures depending on the metal or metals being electropolished Under electropolishing conditions (i.e., high voltage and high current), such a solution is able to degrade tantalum and tantalum alloys. For example, tantalum is removed from the solid metal structure according to the following reaction:

$$3SO_4^{-2}+12H^++2Ta\rightarrow 3H_2SO_3+3H_2O+2Ta^{+3} \qquad \text{Formula 1}$$

The electropolishing electrolyte solution may be substantially anhydrous. When electropolishing articles fabricated from tantalum or a tantalum alloy (e.g., stent 300 or closure element 330 described in detail below), water is capable of poisoning the electropolishing solution because, under electropolishing conditions, tantalum reacts with water to form an insulating oxide layer on the surface of the tantalum metal article. As can be seen from Formula 1, however, water is produced in the electropolishing process as a by-product of the reaction of tantalum metal with sulfate. In addition, alcohol solutions are naturally hygroscopic and, moreover, the electropolishing electrolyte solutions described herein are typically chilled below the dew point of atmospheric water while in use, which can further lead to the condensation of water in the electropolishing electrolyte solution.

Thus, when a critical amount of water is introduced into the electropolishing electrolyte solution, the ability of the solution to electropolish tantalum and tantalum alloys is deactivated. However, the lifespan of the electropolishing electrolyte solution can be extended or a deactivated electropolishing electrolyte solution can be reactivated by adding $P_2O_5$ to the electropolishing solution. $P_2O_5$ can maintain and/or restore the anhydrous nature of the electropolishing electrolyte solution by reacting with any water that is produce during the electropolishing process and/or water absorbed from the air. The water undergoes a chemical reaction that combines water and $P_2O_5$ to yield phosphoric acid according to the following reaction:

$$P_4O_{10}+6H_2O\rightarrow 4H_3PO_4 \qquad \text{Formula 2}$$

Generating phosphoric acid in situ can also prolong the life of the electropolishing electrolyte solution and/or restore the electropolishing electrolyte solution by providing an additional source of $H^+$ ions. The electropolishing electrolyte solutions described herein are highly acidic. Nevertheless, in the process of electropolishing tantalum or tantalum alloys, $H^+$ ions are depleted from the electropolishing electrolyte solution, which reduces the efficiency of the electropolishing process. Producing phosphoric acid in situ is capable of replacing some or all of the consumed $H^+$ ions, thus restoring or prolonging the life of the electropolishing electrolyte solution.

Additionally, in many electropolishing electrolyte solutions, water is not used in the electropolishing solution, but water content is increased by absorbed moisture from the air and/or is present in the chemicals added to the solvent to mix the EP solution. Under electropolishing conditions (i.e., high voltage and high current), water can be broken down by electrolysis or other reaction conditions to create gas bubbles such as hydrogen and oxygen that can adhere to the material being electropolished. Since the electropolishing reaction generally cannot occur through the gas bubbles, the surface quality (smoothness) of the electropolished article can be compromised. That is, gas bubbles adhering to the surface of the part being electropolished can locally interrupt the flow of electrolyte around the surface and interrupt the flow of current to localized portions of the surface. This can lead to a lack of uniformity in the electropolished surface.

$P_2O_5$ is readily available in a granular or powdered form that can be added to the electropolishing electrolyte solution during the mixing process. Alternatively, a solid mass of $P_2O_5$ can be added to the electropolishing electrolyte and allowed to rest in the solution during the electropolishing process. It should be noted that $P_2O_5$ does not dissolve in the electropolishing electrolyte solution in the absence of water. As the $P_2O_5$ reacts with water produced in the electropolishing process or water introduced from the environment, a viscous outer coating forms on the $P_2O_5$ that tends to slow down or moderate its reaction with water in the electrolyte.

In one embodiment, the $P_2O_5$ may be placed in a porous container that is then placed in the electrolyte reservoir. Such a container could be made from a material such as a mesh or screen made from a suitable acid-resistant material such as, but not limited to, polyethylene, polypropylene, PTFE, and the like. Such a container may, for example, be capable of containing the viscous mass, limit the need to clean excess $P_2O_5$ from the reservoir, provide a sufficient surface area to the viscous mass to attain a sufficient reaction rate to regulate water content in the electrolyte, and/or aid in safely handling $P_2O_5$.

Adding $P_2O_5$ to the electropolishing electrolyte solution may yield a number of useful outcomes in addition to those discussed above. For example, by increasing the electrolyte longevity, less hazardous waste may be produced. That is, the used electropolishing electrolyte solution may be classified as hazardous waste and increasing the useful life of the electrolyte reduces the amount of electrolyte that has to be disposed of. Likewise, increasing the electrolyte longevity can lead to an overall increase in manufacturing efficiency. This is due at least in part to the fact that the electrolyte needs changed less frequently. In addition, because the electropolishing electrolyte solution is more effective if it is anhydrous, a better surface finish may be obtained at more rapid erosion rates if water contamination is prevented.

It should be noted, however, that $P_2O_5$ can be dangerous to handle and work with. Experiments have shown that $P_2O_5$ in the electropolishing electrolyte solution produces phosphoric acid through a highly exothermic reaction. Also, it has been noted that the $P_2O_5$ efficiently absorbs moisture in the air to feed this reaction, which causes issues with material degradation and handling safety. For example, the reaction of $P_2O_5$ with water is exothermic enough that it can cause unsafe heating of the electropolishing electrolyte solution. In one embodiment, therefore, $P_2O_5$ can be encapsulated using an encapsulating agent to enhance the safety of handling $P_2O_5$ and to promote a slower reaction of a gradual release of $P_2O_5$ into the water that is evolved or absorbed into the electropolishing electrolyte solution. This allows for a more gradual dissolution of $P_2O_5$ within water and thereby improves the safety of mixing an electrolyte. It also improves the stability of the $P_2O_5$ and prevents undesirable exothermic reactions outside of the electrolytic bath that can be hazardous to the material handler.

In one embodiment, $P_2O_5$ may be encapsulated with an encapsulating agent selected from the group consisting of carrageenan, a polyethylene glycol (PEG), a cellulose gum, gelatin, a starch, and combinations thereof.

In one embodiment, $P_2O_5$ may serve as the core material in a process to produce an encapsulated $P_2O_5$. Several encapsulation processes are well known in the art, generally falling into either the category of physical or chemical methods. Physical methods include pan coating, air-suspension coating, centrifugal extrusion, vibrational nozzle, and spray-drying methods. Chemical methods include interfacial polymerization, in-situ polymerization, and matrix polymerization. Any of these methods may be adapted to produce an encapsulated $P_2O_5$.

Using one of these methods or another method, a shell is formed around the $P_2O_5$ core, protecting it from the surrounding environment and protecting is from rapid dissolution in the electropolishing electrolyte solution. A suitable shell material is one that is non-reactive with $P_2O_5$ and that exhibits sufficient stability to not rapidly degrade under relative humidity levels below about 75% and preferably will not degrade under relative humidity levels below 100%. However, the shell material should degrade within about 30 minutes of being immersed in water, and preferably within about 5 minutes of being immersed in water.

Therefore, in one embodiment, $P_2O_5$ may be encapsulated with a carrageenan. Carrageenans are a family of linear sulphated polysaccharides extracted from red seaweeds. Carrageenans are dried, baled, and ground to remove impurities and treated with hot alkali solution resulting in a carrageenan solution that is concentrated by evaporation. Carrageenans are commonly added to foods as a thickener and various grades of carrageenans have been used to capsulate medicines because they easily dissolve in solution.

Encapsulating $P_2O_5$ may help prevent the encapsulated $P_2O_5$ from degrading under ambient conditions, providing greater process stability. Likewise, encapsulated $P_2O_5$ will likely hydrolyze more gradually in the electropolishing electrolyte solution, reducing the likelihood of a boil over and improving material handling safety.

In addition to $P_2O_5$, the electropolishing electrolyte solution may include at least one substance that is capable of sequestering water. One example of a compound that can sequester water is polyethylene glycol ("PEG"). PEGs are oligomers or polymer of ethylene oxide. PEGs are prepared by polymerization of ethylene oxide and are commercially available over a wide range of molecular weights from 300 g/mol to 10,000,000 g/mol. PEGs are soluble in alcohol solvent and are generally stable in acid. In one embodiment, the PEG is PEG 1000 (i.e., a PEG with an average molecular weight of about 1000 daltons). PEGs are capable of sequestering water by forming hydrogen bonds that surround individual water molecules or clusters of water. When surrounded by a water sequestering agent like PEG, water molecules are generally less chemically accessible and, as such, they are believed to be less able to poison the electropolishing electrolyte solution. While $P_2O_5$ is generally able to react with water that is introduced into the electropolishing solution, this water sequestering property of PEG may be of particular importance if, for example, all of the $P_2O_5$ is consumed.

It should be noted that while the water control agents, such as $P_2O_5$ and PEG, are described herein in reference to specific electropolishing electrolyte solutions and specific metallic materials, the principles described herein are applicable to any electropolishing process for any material that uses anhydrous electropolishing electrolyte solutions.

Electropolishing Methods

In one embodiment, a method for scavenging water in an electropolishing electrolyte solution is described. The method includes (1) positioning a substantially anhydrous electropolishing electrolyte solution in an electropolishing apparatus, (2) adding a first quantity of $P_2O_5$ to the substantially anhydrous electropolishing electrolyte solution, and (3) electropolishing a metal article in the substantially anhydrous electropolishing electrolyte solution in the electropolishing cell, wherein water evolved during the electropolishing process is scavenged by the phosphorous pentoxide and converted to phosphoric acid.

In another embodiment, a method for electropolishing a metal article includes (1) positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the electrolyte and connected to an electrical power supply, (2) adding a first quantity of $P_2O_5$ to the substantially anhydrous electropolishing electrolyte solution, (3) connecting a metal article to an anode and positioning the metal article in the reservoir in the substantially anhydrous electropolishing electrolyte solution, and (4) running an electrical current through the substantially anhydrous electropolishing electrolyte solution via the anode and the cathode so as to electropolish the metal article. Water evolved during the electropolishing is scavenged by the $P_2O_5$ and degraded by converting the water and the $P_2O_5$ to phosphoric acid so as to preserve the substantially anhydrous electropolishing electrolyte solution.

The methods described herein may further include electropolishing at a substantially constant electrical current while monitoring voltage across the electropolishing cell, and adding a second quantity of $P_2O_5$ to the electropolishing electrolyte solution when the voltage exceeds a selected value. That is, as water is evolved as a by-product of the electropolishing process or as water is absorbed from the air, the $P_2O_5$ may be fully consumed. As the water concentration in the electropolishing electrolyte solution increases, the observed resistance of the solution may increase as the efficiency of the electropolishing process drops, leading to the need to increase the voltage in order to maintain a substantially constant current. As such, additional $P_2O_5$ may be added to scavenge the water in the electropolishing electrolyte solution and thereby restore the electropolishing electrolyte solution.

The methods described herein may employ any of the electropolishing electrolyte solutions described herein. For example, the electropolishing electrolyte solution may include about 5 volume % ("vol %") to about 7 vol % sulfuric acid and about 3 vol % to about 14 vol % methanolic hydrochloric acid. The electropolishing electrolyte solution may further include phosphoric acid. Phosphoric acid may be produced by the reaction of $P_2O_5$ with water, as described in detail elsewhere herein.

EXAMPLES

Working Example 1

An electropolishing electrolyte solution may be prepared in the following manner:

1. Turn on chiller, wait until temperature is below 0° C.
2. Cool methanol at least 3 hours prior to mixing.
3. Measure 1600 ml of Methanol and place it in a double-walled beaker that is attached to the chiller.
4. Put a thermometer into the beaker to measure solution temperature. The temperature must be below 0° C. before proceeding to the next step.
5. Measure 130 ml of sulfuric acid and slowly pour the acid into the beaker along the edge, then stir to mix the acid thoroughly with the methanol.

Note: if temperature of solution rise above 10° C., stop adding the acid and wait for the temperature to drop below 0° C.

6. Measure 282 ml of methanolic HCl and slowly pour into the beaker along the edge. Stir solution until a vortex is formed to mix thoroughly.
7. Pour the mixture into storage container, close cap securely and store in refrigerator.
8. Approximately 10 g or more of $P_2O_5$ may be added per approximately 1000 ml of the electropolishing solution at the time of use.

Working Example 2

Stents are typically electropolished at a control current a range of 1-5 Amps for 3-4 cycles of 4-12 seconds per cycle. However, these parameters are dependent on the size of the stent, how much material is removed from the stent, etc. The temperature of the electrolyte during electropolishing is kept between −10 and +5 degrees Celsius. Additional $P_2O_5$ can be added at regular intervals during the electropolishing or as visual inspection of the electropolished articles indicates declining electropolishing quality.

Working Example 3

A suitable electropolishing solution used in this Example includes the following concentrations: Approximately 90.3% methanol, 6.3% sulfuric acid, and 3.4% methanolic HCl (percent by volume). This solution was found to be effective for electropolishing stents fabricated from a tantalum alloy.

To test whether or not water can inactivate the electropolishing electrolyte and to test the effectiveness of $P_2O_5$ in reversing the inactivation of the electropolishing electrolyte, approximately 40 ml of water was added to approximately 1000 ml of the solution. It was found that this addition of water was sufficient to inactivate the electropolishing electrolyte and to make it ineffective for electropolishing stents fabricated from the tantalum alloy.

It was further found that the electropolishing electrolyte could be reactivated by adding approximately 20 g of $P_2O_5$ to the electropolishing electrolyte. That is, after the addition of $P_2O_5$ to the electropolishing electrolyte, the solution was again effective for electropolishing stents fabricated from the tantalum alloy.

Working Example 4

A suitable electropolishing solution used in this Example includes the following concentrations: Approximately 90.3% methanol, 6.3% sulfuric acid, and 3.4% methanolic HCl (percent by volume). This solution was found to be effective for electropolishing stents fabricated from a tantalum alloy.

Using this solution, approximately 60 tantalum alloy stents could be electropolished effectively at a current of about 3 amps and a voltage of about 9-10 volts in a volume of 1000 ml. After about 60 tantalum alloy stents, the solution was considered to be ineffective for electropolishing stents fabricated from the tantalum alloy (high voltage (i.e., above about 11 volts) required, poor surface finish).

It was found that the electropolishing electrolyte could be reactivated by adding approximately 20 g of $P_2O_5$ to the electropolishing electrolyte. That is, after the addition of $P_2O_5$ to the electropolishing electrolyte, the solution was again effective (lower voltage (i.e., about 9-10 volts), good surface finish) for electropolishing stents fabricated from the tantalum alloy.

Figure 3A:
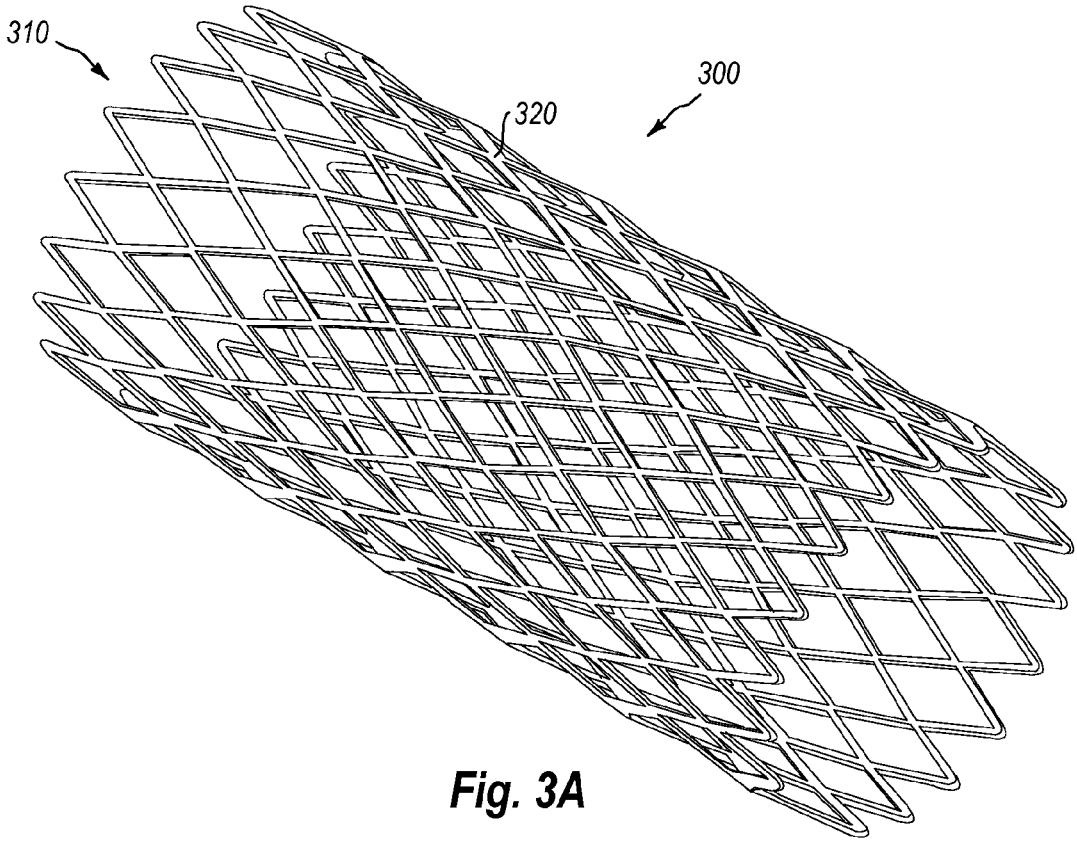
FIG. 3A is an isometric view of a stent made from a tantalum alloy according to an embodiment of the present disclosure.

Tantalum-Alloy Products, such as Stents and Other Implantable Medical Devices As discussed above, the disclosed electropolishing solutions and methods are particularly suitable for electropolishing tantalum-based articles, such as stents. FIG. 3A is an isometric view of a stent 300 made from a tantalum alloy according to an embodiment of the present disclosure. The stent 300 includes a stent body 310 sized and configured to be implanted and deployed into a lumen of a living subject. The stent body 310 may be defined by a plurality of interconnected struts 320 configured to allow the stent body 310 to radially expand and contract. However, it is noted that the illustrated configuration for the stent body 310 is merely one of many possible configurations, and other stent-body configurations made from the inventive tantalum-alloy products disclosed herein are encompassed by the present disclosure. For example, the struts 320 may be integrally formed with each other as shown in the illustrated embodiment, separate struts may be joined together by, for example, welding or other joining process, or separate stent sections may be joined together.

The stent body 310 is made from a tantalum alloy that is composed and heat-treated to obtain one or more of certain desirable microstructural, mechanical, or chemical properties. For example, the tantalum alloy may be heat treated to modify at least one mechanical property thereof, such as ductility, yield strength, or ultimate tensile strength. It has been found that a tantalum alloy that includes tantalum, niobium, and at least one additional element selected from the group consisting of tungsten, zirconium, molybdenum, and/or at least one of hafnium, rhenium, and cerium can fulfill the mechanical and biocompatibility requirements needed for functioning as in a medical device.

The tantalum alloy includes a tantalum content of about 78 weight-percent ("wt %") to about 91 wt %, a niobium content of about 7 wt % to about 12 wt %, and a tungsten content of about 1 wt % to about 10 wt %. However, the tantalum alloy may also include other alloying elements, such as one or more grain-refining elements in an amount up to about 5 wt % of the tantalum alloy. For example, the one or more grain-refining elements may include at least one of hafnium, cerium, or rhenium. Tungsten is provided to solid-solution strengthen tantalum, and niobium is provided to improve the ability of tantalum to be drawn. The tantalum alloy is a substantially single-phase, solid-solution alloy having a body-centered cubic crystal structure. However, some secondary phases may be present in small amounts (e.g., inclusions) depending upon the processing employed to fabricate the tantalum alloy.

The composition of the tantalum alloy may be selected from a number of alloy compositions according to various embodiments. In an embodiment, the niobium content is about 9 wt % to about 10.5 wt %, the tungsten content is about 6.0 wt % to about 8 wt %, and the balance may include tantalum (e.g., the tantalum content being about 80 wt % to about 83 wt %) and, if present, other minor alloying elements and/or impurities. In a more detailed embodiment, the niobium content is about 10 wt %, the tungsten content is about 7.5 wt %, and the balance may include tantalum (e.g., the tantalum content being about 82.5 wt %) and, if present, other minor alloying elements and/or impurities. In another more detailed embodiment, the niobium content is about 10 wt %, the tungsten content is about 2.5 wt %, and the balance may include tantalum (e.g., the tantalum content being about 87.5 wt %) and, if present, other minor alloying elements and/or impurities.

In another embodiment, the niobium content is about 10.5 wt % to about 13 wt %, the tungsten content is about 5.0 wt % to about 6 wt %, and the balance may include tantalum (e.g., the tantalum content being about 80 wt % to about 82 wt %) and, if present, other minor alloying elements and/or impurities. In a more detailed embodiment, the niobium content is about 12.5 wt %, the tungsten content is about 5.8 wt %, and the balance may include tantalum (e.g., the tantalum content being about 81 wt % to about 81.5 wt %) and, if present, other minor alloying elements and/or impurities.

In a specific example, the tantalum-containing refractory metal article disclosed herein may be made from a tantalum alloy that includes about 82.5 weight percent tantalum, about 10 weight percent niobium, and about 7.5 weight percent tungsten.

In another specific example, the tantalum-containing refractory metal article disclosed herein may be made from a tantalum alloy that includes about 87.5 weight percent tantalum, about 10 weight percent niobium, and about 2.5 weight percent tungsten.

In an embodiment, the tantalum alloy may exhibit a grain microstructure including recrystallized, generally equiaxed grains characteristic of being formed by heat treating a precursor product of the stent body 410 or the stent body 410 itself, both of which may be severely plastically deformed in a drawing process. Depending upon the extent of recrystallization process, the grain microstructure may be only partially recrystallized. In some embodiments, the recrystallization process may substantially completely recrystallize the grain microstructure with the new recrystallized grains having consumed substantially all of the old deformed grains. Even when the grain microstructure is partially recrystallized, it will be apparent from microstructural analysis using optical and/or electron microscopy that the grain microstructure includes some recrystallized grains having, for example, a generally equiaxed geometry. An average grain size of the tantalum alloy may be about 10 μm to about 20 μm and, more particularly, about 13 μm to about 16 μm depending on the extent of recrystallization and the amount of the optional one or more grain-refining alloy elements in the tantalum alloy.

In other embodiments, the tantalum alloy may be stress relieved at a temperature below a recrystallization temperature of the tantalum alloy so that the grain microstructure is relatively unchanged from the as-drawn condition. Thus, in the stress-relieved condition, the grain microstructure may include essentially only non-equiaxed, deformed, cold-worked grains. However, the stress-relief heat treatment may at least partially remove at least one of hydrogen, oxygen, or oxygen from the tantalum alloy, which can detrimentally embrittle the tantalum alloy. Thus, the tantalum alloy in the stress-relieved condition may exhibit an improved ductility relative to the as-drawn condition, while the tensile yield strength and tensile ultimate tensile strength are generally unaffected by the stress-relief heat treatment.

The heat-treated refractory metal alloy from which the articles disclosed herein may be made may exhibit combination of strength (e.g., tensile yield strength and ultimate tensile strength) and ductility (e.g., percent elongation) suitable to withstand loading conditions encountered when implanted and utilized in a lumen of a living subject. The tensile yield strength may be the 0.2% offset yield strength determined in a uniaxial tensile test when no yield point is present, and the yield point if the tantalum alloy exhibits a yield point. For example, the tantalum alloy may exhibit a tensile elongation of about 9% to about 40%, a tensile yield strength of about 400 MPa to about 815 MPa, and an ultimate tensile strength of about 500 MPa to about 850 MPa as determined by, for example, tensile testing a tubular body from which the stent body may be cut from or a drawn wire in a uniaxial tensile test. In an embodiment, the tantalum alloy (e.g., about 82.5 wt % tantalum, about 10 wt % niobium, and about 7.5 wt % tungsten) may exhibit a tensile elongation of about 9% to about 40%, a tensile yield strength of about 455 MPa to about 810 MPa, and an ultimate tensile strength of about 515 MPa to about 850 MPa. In another embodiment, the tantalum alloy may exhibit a tensile elongation of about 10% to about 25%, a tensile yield strength of about 400 MPa to about 500 MPa, and an ultimate tensile strength of about 500 MPa to about 550 MPa. In one embodiment, the tantalum alloy may exhibit a tensile elongation of about 20% to about 23%, a tensile yield strength of about 450 MPa to about 500 MPa, and an ultimate tensile strength of about 500 MPa to about 550 MPa.

In an embodiment, a heat-treated refractory metal from which the articles disclosed herein may be fabricated is made having a tantalum content of about 87.5 wt %, a niobium content of about 10 wt %, and a tungsten content of about 2.5 wt % and an at least partially recrystallized grain microstructure may exhibit a tensile elongation of about 9% to about 40%, a tensile yield strength of about 400 MPa to about 800 MPa, and an ultimate tensile strength of about 500 MPa to about 850 MPa. In one embodiment, the heat-treated tantalum alloy may exhibit a tensile elongation of about 10% to about 25%, a tensile yield strength of about 400 MPa to about 500 MPa, and an ultimate tensile strength of about 500 MPa to about 550 MPa.

In an embodiment, a stress-relieved refractory metal alloy from which the articles disclosed herein may be fabricated is made having a tantalum content of about 82.5 wt %, a niobium content of about 10 wt %, and a tungsten content of about 7.5 wt % may exhibit a percent elongation of about 9% to about 15% (e.g., about 10% to about 11%), a tensile yield strength of about 650 MPa to about 850 MPa, and an ultimate tensile strength of about 700 MPa to about 850 MPa. In the stress-relieved condition, the percent elongation of the tantalum alloy may increase by at least about 100%, at least about 200%, at least about 300%, or about 200% to about 300% compared to the same tantalum alloy in the as-drawn (i.e., un-stress-relieved condition), while the tensile yield strength and ultimate tensile strength are reduced. As yield strength and ultimate tensile strength go down, the ductility of the tantalum alloy tends to increase. The reduction in tensile yield strength and ultimate tensile strength and the increase in ductility needs to be balanced, but, in general, increasing ductility tends to yield a more durable medical device fabricated from the tantalum alloy. For example, an alloy having increased ductility is less likely to crack when radially stressed. The grain microstructure may also be relatively unchanged from the as-drawn condition and may include deformed, non-equiaxed grains.

In an embodiment, the tantalum alloy may exhibit a grain microstructure including recrystallized, generally equiaxed grains characteristic of being formed by heat treating a precursor product of the stent body 310 or the stent body 310 itself, both of which may be severely plastically deformed in a drawing process. Depending upon the extent of recrystallization process, the grain microstructure may be only partially recrystallized. In some embodiments, the recrystallization process may substantially completely recrystallize the grain microstructure with the new recrystallized grains having consumed substantially all of the old deformed grains. Even when the grain microstructure is partially recrystallized, it will be apparent from microstructural analysis using optical and/or electron microscopy that the grain microstructure includes some recrystallized grains having, for example, a generally equiaxed geometry. An average grain size of the tantalum alloy may be about 10 μm to about 20 μm and, more particularly, about 13 μm to about 16 μm depending on the extent of recrystallization and the amount of the optional one or more grain-refining alloy elements in the tantalum alloy.

In other embodiments, the tantalum alloy may be stress relieved at a temperature below a recrystallization temperature of the tantalum alloy so that the grain microstructure is relatively unchanged from the as-drawn condition. Thus, in the stress-relieved condition, the grain microstructure may include essentially only non-equiaxed, deformed, cold-worked grains. However, the stress-relief heat treatment may at least partially remove at least one of hydrogen, oxygen, or oxygen from the tantalum alloy, which can detrimentally embrittle the tantalum alloy. Thus, the tantalum alloy in the stress-relieved condition may exhibit an improved ductility relative to the as-drawn condition, while the tensile yield strength and tensile ultimate tensile strength are generally unaffected by the stress-relief heat treatment.

The disclosed heat-treated tantalum alloys are sufficiently radiopaque and stronger (e.g., greater yield strength) than substantially pure tantalum (e.g., commercially pure tantalum). Consequently, the struts 320 of the stent body 310 may be thinner in a radial direction than a stent made from substantially pure tantalum and having a similar configuration, while still providing the same, better, or adequate imaging characteristics under X-ray fluoroscopy and MRI. Commercially pure tantalum exhibits a relatively greater radiopacity. However, since commercially pure tantalum is much weaker than the tantalum alloys disclosed herein, a stent made from commercially pure tantalum typically could be excessively thick for structural reasons thereby resulting in the stent being excessively radiopaque and making it difficult to distinguish surrounding body tissue during imaging.

Referring still to FIG. 3A, for example, an average thickness "t" of the struts 320 of the stent body 310 in a radial direction may be about 40 μm to about 100 μm, about 60 μm to about 80 μm, about 50 μm to about 90 μm, about 50 μm to about 77 μm, about 53 μm to about 68.5 μm, or about 58 μm to about 63.5 μm, while also exhibiting the desirable disclosed combination of strength, ductility, and radiopacity as discussed hereinabove. Because the disclosed heat-treated tantalum alloys are sufficiently strong as characterized by yield strength, ultimate tensile strength, radial strength, or combinations of the foregoing mechanical properties, the average thickness "t" of the struts 320 of the stent body 310 may be made sufficiently thin to help reduce vessel injury and enhance deliverability while still having a sufficient radiopacity to be visible in X-ray fluoroscopy and MRI.

In one or more embodiments, the stent body 310 may be etched in an acid (e.g., hydrofluoric acid) to remove heat-affected zones associated with forming the struts 320 via laser cutting and/or electropolished to improve a surface finish of the stent body 310. In such embodiments, the stent body 310 may be heat treated (e.g., a stress-relief heat treatment or recrystallization heat treatment) so that at least one of hydrogen, oxygen, or nitrogen introduced to the tantalum alloy from the acid and/or the electropolishing solution is at least partially removed. Following heat treatment, the stent body 310 may include one or more etched and/or one or more electropolished surfaces, and the tantalum alloy that forms the stent body 310 may substantially free of at least one of hydrogen, oxygen, or nitrogen or include at least one of hydrogen, oxygen, or nitrogen in an amount below a threshold concentration sufficient to cause environmental cracking in the tantalum alloy, such as hydrogen that causes hydrogen embrittlement. For example, oxygen may be present in the tantalum alloy in a concentration of about 400 ppm or less (e.g., about 100 ppm to about 300 ppm) without causing embrittlement.

Figure 3B:
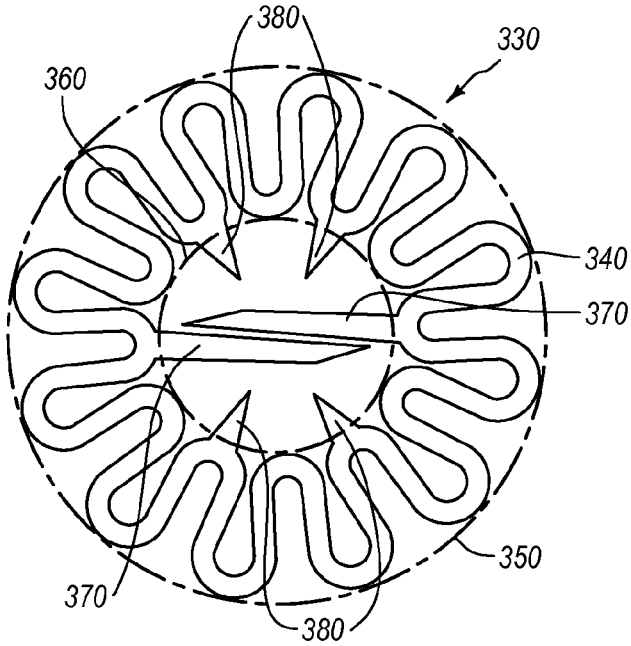
FIG. 3B is a plan view of a closure element made from any of the tantalum alloys disclosed herein according to an embodiment of the present disclosure.

Other implantable medical devices besides stents may employ a tantalum alloy exhibiting one or more of the disclosed tailored properties, such as guide wires, closure elements, pacemaker leads, orthopedic devices, embolic coils, sutures, prosthetic heart valves, mitral valve repair coils, or other medical devices or portions thereof for deploying the foregoing medical devices. For example, FIG. 3B illustrates a closure element 330 (e.g., a staple) made from any of the heat-treated tantalum alloys disclosed herein. The closure element 330 includes a body 340 defining an outer perimeter 350, an inner perimeter 360, primary tines 370, and secondary tines 380.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for scavenging water in an electropolishing electrolyte solution, comprising:

positioning a substantially anhydrous electropolishing electrolyte solution in an electropolishing cell;

adding a first quantity of phosphorous pentoxide to the substantially anhydrous electropolishing electrolyte solution;

electropolishing a metal article in the substantially anhydrous electropolishing electrolyte solution in the electropolishing cell at a substantially constant electrical current while monitoring voltage across the electropolishing cell, wherein water evolved during the electropolishing process is substantially scavenged by the phosphorous pentoxide and converted to phosphoric acid; and adding a second quantity of phosphorous pentoxide to the electropolishing electrolyte solution when the voltage exceeds a selected value.

2. The method of claim 1, wherein the substantially anhydrous electropolishing electrolyte solution includes about 5 volume % ("vol %") to about 7 vol % sulfuric acid and about 3 vol % to about 14 vol % methanolic hydrochloric acid.

3. The method of claim 1, wherein the substantially anhydrous electropolishing electrolyte solution further includes phosphoric acid.

4. The method of claim 1, wherein the phosphorous pentoxide is encapsulated with an encapsulating agent selected from the group consisting of carrageenan, a polyethylene glycol (PEG), a cellulose gum, gelatin, a starch, and combinations thereof.

5. The method of claim 1, further comprising adding a quantity of polyethylene glycol to the substantially anhydrous electropolishing electrolyte solution.

6. The method of claim 1, wherein the substantially anhydrous electropolishing electrolyte solution comprises:

an alcohol including methanol added in an amount of about 79.5 vol %;

at least one mineral acid including concentrated methanolic hydrochloric acid added in an amount of about 14 vol % and concentrated sulfuric acid added in an amount of about 6.5 vol %; and an encapsulated phosphorus pentoxide.

7. The method of claim 1, wherein the metal article is an implantable stent fabricated from a tantalum alloy.

8. The method of claim 7, wherein the tantalum alloy comprises:

about 75 to about 80 weight percent tantalum;

about 8 to about 12 weight percent niobium; and about 2 to about 10 weight percent tungsten.

9. A method for electropolishing a metal article, comprising:

positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the substantially anhydrous electropolishing electrolyte solution and connected to an electrical power supply;

adding a first quantity of phosphorous pentoxide to the substantially anhydrous electropolishing electrolyte solution;

connecting a metal article to an anode and positioning the metal article in the reservoir in the substantially anhydrous electropolishing electrolyte solution;

running an electrical current through the substantially anhydrous electropolishing electrolyte solution via the anode and the cathode so as to electropolish the metal article, wherein water evolved during the electropolishing is substantially scavenged by the phosphorous pentoxide and converted to phosphoric acid so as to preserve the substantially anhydrous electropolishing electrolyte solution;

monitoring electrical current and voltage across the electropolishing cell during the electropolishing; and adding a second quantity of phosphorus pentoxide to the substantially anhydrous electropolishing solution when the voltage exceeds a selected value.

10. The method of claim 9, wherein the substantially anhydrous electropolishing electrolyte solution includes about 5 volume % ("vol %") to about 7 vol % sulfuric acid, about 3 vol % to about 14 vol % methanolic hydrochloric acid, and a balance of methanol.

11. The method of claim 9, wherein the metal article is a stent fabricated from a tantalum alloy.

12. The method of claim 11, wherein the tantalum alloy comprises:

about 75 to about 80 weight percent tantalum;

about 8 to about 12 weight percent niobium; and about 2 to about 10 weight percent tungsten.

13. The method of claim 9, wherein the phosphorous pentoxide is encapsulated with an encapsulating agent selected from the group consisting of carrageenan, a polyethylene glycol (PEG), a cellulose gum, gelatin, a starch, and combinations thereof.

14. The method of claim 9, further comprising adding at least one agent to the substantially anhydrous electropolishing electrolyte solution that is capable of sequestering water evolved during the electropolishing.

15. The method of claim 14, wherein the at least one agent capable of sequestering water evolved during the electropolishing is PEG 1000.

* * * * *